US006286569B1

(12) United States Patent
Brandenburg et al.

(10) Patent No.: US 6,286,569 B1
(45) Date of Patent: Sep. 11, 2001

(54) MATERIAL DISPENSING AND RECOVERY SYSTEM

(76) Inventors: Carl M. Brandenburg, 111 Sitton Shoals Rd., Seneca, SC (US) 29678; James A. Lockwood, 2026 Sunset Dr., Seneca, SC (US) 29672

( * ) Notice: Subject to any disclaimer, the term of this patent is extended or adjusted under 35 U.S.C. 154(b) by 0 days.

(21) Appl. No.: 09/495,689

(22) Filed: Feb. 1, 2000

(51) Int. Cl.[7] ..... B65B 1/04; B65B 3/00; B67C 3/00

(52) U.S. Cl. ..... 141/369; 141/86; 141/123; 141/126; 141/45; 141/67

(58) Field of Search ..... 141/18, 37, 44, 141/45, 67, 80, 86, 115, 121, 123, 126, 369, 311 R, 285, 290; 406/82, 108, 117; 53/239

(56) References Cited

U.S. PATENT DOCUMENTS 1,437,876 * 12/1922 Tyler ..... 141/315
4,020,881 * 5/1977 Nothen ..... 141/1
4,934,875 * 6/1990 Fuss ..... 406/117
4,947,903 * 8/1990 Beckwith ..... 141/67
5,363,887 * 11/1994 Haeberli ..... 141/12

* cited by examiner

*Primary Examiner*—Timothy L. Maust
(74) *Attorney, Agent, or Firm*—Bernard A. Chiama

(57) ABSTRACT

A material handling system for dispensing and recovering particulate material, such as, packaging material, known as "Peanuts", includes a supply container for the material having a valve for controlling the dispensing of the material into shipping cartons positioned below on a work table. The work table is formed with openings through which packaging material may be dumped from incoming cartons by upending same allowing the material to fall into a collection container and thence into a transition chamber, such as a trap container. A vacuum system including pipes is arranged to draw out material collected in the transition chamber and convey the material back to the supply container for reuse. A hose may be selectively connected to the vacuum system for use in recovering loose material falling outside of the material handling system.

3 Claims, 6 Drawing Sheets

MATERIAL DISPENSING AND RECOVERY SYSTEM

BACKGROUND OF THE INVENTION

This invention relates generally to a system for the dispensing of particulate material, into shipping containers, and the recovery therefrom after shipment, and more particularly, for the dispensing and removal of packaging material, such as, what is referred to in the packaging industry as "peanuts" or "popcorn, relative to boxes or cartons suitable for direct use by consumers, or for shipment to distribution centers or retail stores.

In the packaging peanut industry, whether at mail order houses, or small store businesses, peanuts are usually brought to the packaging center in large quantities, such as by bulk truck loads and/or large overflowing bins. Handling of such large quantities upon arrival to such a dispensing center and the eventual filling of small packages for customer use is time consuming, labor intensive and wasteful. Upon opening a large bulk load or bin, the peanuts typically fly out of the load container or bin under the forces of wind and static electricity, and the result of bulk handling. Additional containers are usually required in which to transfer peanuts for holding purposes as one disposes the contents of the original container, thereby requiring unnecessary manpower, time and space.

Another problem associated with the handling of peanuts occurs during the actual dispensing of peanuts into package receptacles, suitable for eventual distribution directly to consumers or to retail stores. During actual filling of the small package containers, which occur at relatively high speed, peanuts are thrown, or otherwise spill, such as by overflow, from these package receptacles, and fall upon the floor in wild profusion. These peanuts must be swept up and carried to a dump site as lost products, or must be shovelled or otherwise returned by hand to the original supply container, for the refilling operation. These unpleasant and costly, time consuming activities have seriously affected the efficiency of packaging small receptacles of peanuts, especially for the small operators and retail owners, who package their own receptacles or containers.

Still another problem in peanut handling occurs after a carton is opened and the one or more items being shipped are removed. The carton now contains a large quantity of loose packaging material which must be further handled, as by being taken to another location for discarding, or to be vacuumed out of the carton and perhaps returned to a supply container, either action of which requires the operator to be diverted from his primary function, that of removing the items being shipped and expediting their handling.

There are systems in the prior art which disclose the dispensing of particulate material into shipping containers, and which may include devices for vacuuming the same type of material from a shipping container for later use, after shipment of a container to the site of dispensing. In U.S. Pat. No. 5,323,819 to Shade, there is disclosed a dispensing and recovering system having an overhead storage bag, a dispensing valve for controlling the dispensing of particulate material therefrom, and a vacuum system arranged in the storage bag for creating a vacuum in the bag and a hose in communication therewith for permitting the evacuation of packaging material from incoming packages. The patentee is more concerned with the handling of material as it enters and is deposited into the upper storage bag, as material is sucked therein by the vacuum device. Since the particulate material being handled is inexpensive, perhaps there is no concern or need for the recovery of loose material for later use. Therefore, there is no disclosure regarding the recovery and return of overflow or spilled material as one or more packaging receptacles are being handled.

The material recovery apparatus as disclosed in U.S. Pat. No. 4,947,903 to Beckwith is similar to the previously mentioned patent in that an overhead supply container is provided to hold a large quantity of particulate material, for dispensing into shipping cartons. A vacuum system is also described for permitting an operator to retrieve the same type of material from shipped containers, to clean up spilled material which may fall upon a work table or the floor, and to return the material to the supply container or to be otherwise discarded. During the clean-up phase of operation, the operator must divert his direct attention from the filling of containers in order to apply his vacuum system to the clean-up phase, thereby reducing the production capacity of his apparatus.

The packing and recovery system disclosed in U.S. Pat. No. 5,741,093 to Schonberg et al, includes a collection hopper in operative conjunction with a vacuum system having a wand and vacuum hose arranged to pick up packaging material, and to convey the material to the collection hopper. The patentees are more concerned with the use of compressed air to produce a vacuum condition in a vacuum hose, and in devices for adjusting the vacuum.

In U.S. Pat. No. 5,088,860 to Stockdale et al, a vacuum system is disclosed as being particularly adapted for recovery of packaging material, such as "peanuts" or "popcorn". In this disclosure, attention is directed mostly with the details of the vacuum producing device which draws out the material from a shipping carton and transports the same to a storage bag. Although it may be assumed that the vacuum system can be utilized for retrieving the material from the floor, for example, there is no disclosure of this function. In addition, there is no provision or even a possibility for dispensing material into cartons, or the like. The patented device in U.S. Pat. No. 5,088,860 is similar to the device disclosed in U.S. Pat. No. 4,947,903 in that both devices require the use of one hand for the operation of the vacuum hose leaving only one hand available for unpacking the packed one or more items.

A bulk material handling apparatus, disclosed in U.S. Pat. No. 4,668,131 to Hart et al, is arranged to convey bulk particulate material from one holding tank to another. A bulk material loading container is arranged on a mobile, material loading machine to be moved thereby for loading and unloading materials into and from bulk tank cars. There is no provision for dispensing and recovering material relative to a stationary work station to permit an operator to perform these functions thereat.

SUMMARY OF THE INVENTION

The present invention was devised to solve specific problems with the handling of packaging particulate material, such as, the packaging material known as "peanuts". These problems involve: 1) the recovery of the material which spill out of shipping receptacles or boxes during filling or because of overflow, 2) the refilling of a supply container for dispensing purposes, and 3) the recovery of the spillage and excess particulate material during and after the removal of shipped item or items from shipping boxes. To this end, a frame is provided for supporting in vertical alignment the three main components of the material packaging and recovery apparatus. The upper-most component mounted on the frame includes a large, supply container arranged to receive peanuts from a peanut recovery system to be described below. The upper container includes a valve mechanism positioned below the upper container being arranged to control dispensing of the peanuts therein by an operator.

A work station is positioned vertically below the valve mechanism whereat an operator may stand while manipulating the valve mechanism while dispensing peanuts into shipping boxes or cartons. The work station includes a worktable upon which the box(es) to-be-filled during the dispensing operation, or boxes to be unpacked during a receiving operation, are supported. Spaced-apart, parallel bars, preferably roller bars, make up the horizonal surface of the worktable, with the bars spaced from each other a distance greater than the size of the peanuts being processed, but close enough so the the boxes can be supported without disruption. During filling of the boxes, peanuts which fail to enter a box being filled and spill around the box, or because of overflow conditions, or peanuts spilled while unpacking items from a box, will drop onto and through the bars of the worktable and fall into a container, which comprises the third and lower component of the inventive apparatus. The lower component includes a collection container for receiving the spilled or overflow, or excess peanuts, and a blower mechanism adapted to produce vacuum conditions in a trap receptacle/conduit system arranged to receive material from this container and to return the same to the supply container. Upon activation of the blower mechanism to produce a vacuum in the conduit, peanuts are drawn from the lower container and transported upwardly to the supply container where they once again are in position to be dispensed.

In the interest of conserving time and manpower in the relatively labor-intensive packaging industry, the present invention permits operative functions that a single operator may perform selectively, sequentially or simultaneously, in the dispensing and recovery of packaging material when handling shipping boxes or cartons, such functions not being available in the prior art. One of the objects of the invention, is to retrieve the one or more shipped items out of a shipping box or carton, without regard to a clean up operation for packaging material therein, and not to spend time coordinating a peanut retrieval effort. The problem inherent in all of the vacuum systems, as noted in the above disclosed patents, is the follow-up time required after the one or more shipped items is removed from its container. It is a time consuming, unnecessary operation to divert attention to the use of a vacuum system to remove the peanuts from a shipping container after the item(s) have been removed. In the present invention, the operator simply opens the shipped container, retrieves the item(s) letting the spill-over peanuts fall as they may upon and through the openings between the worktable surface bars, and dumps the remaining peanuts into the lower collection container through the worktable. The vacuum system may be turned on at any time, say for example, during off hours in the event the noise level of the system is obtrusive to surrounding personnel, or at some time when the collection container is full. In any event, the apparatus may be used for dispensing or receiving purposes without requiring the vacuum system to be energized.

DESCRIPTION OF THE PREFERRED EMBODIMENT

Figure 1:
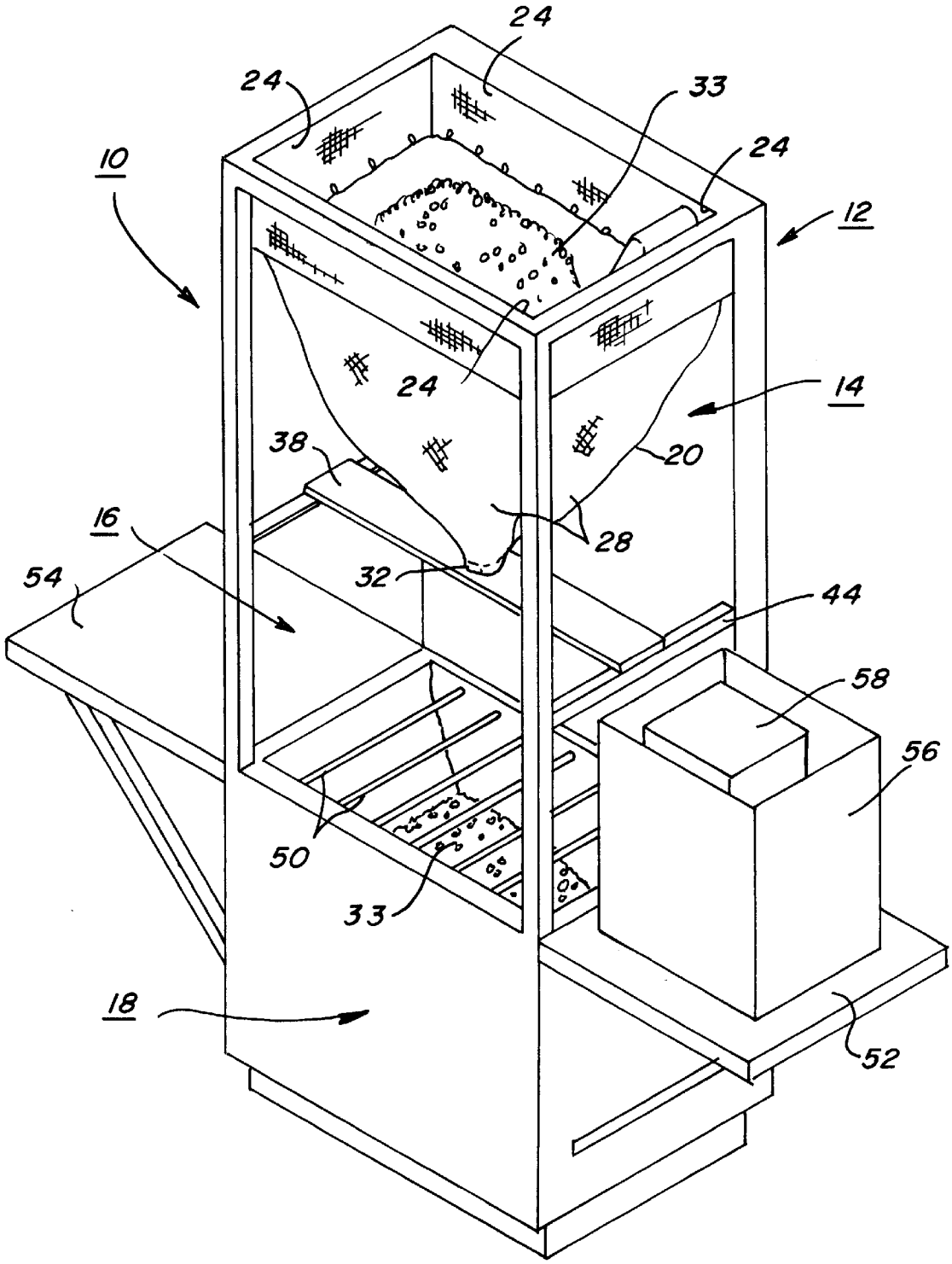
FIG. 1 is an isometric illustration of a particulate material dispensing and recovery apparatus incorporating the principles of the present invention.
Figure 2:
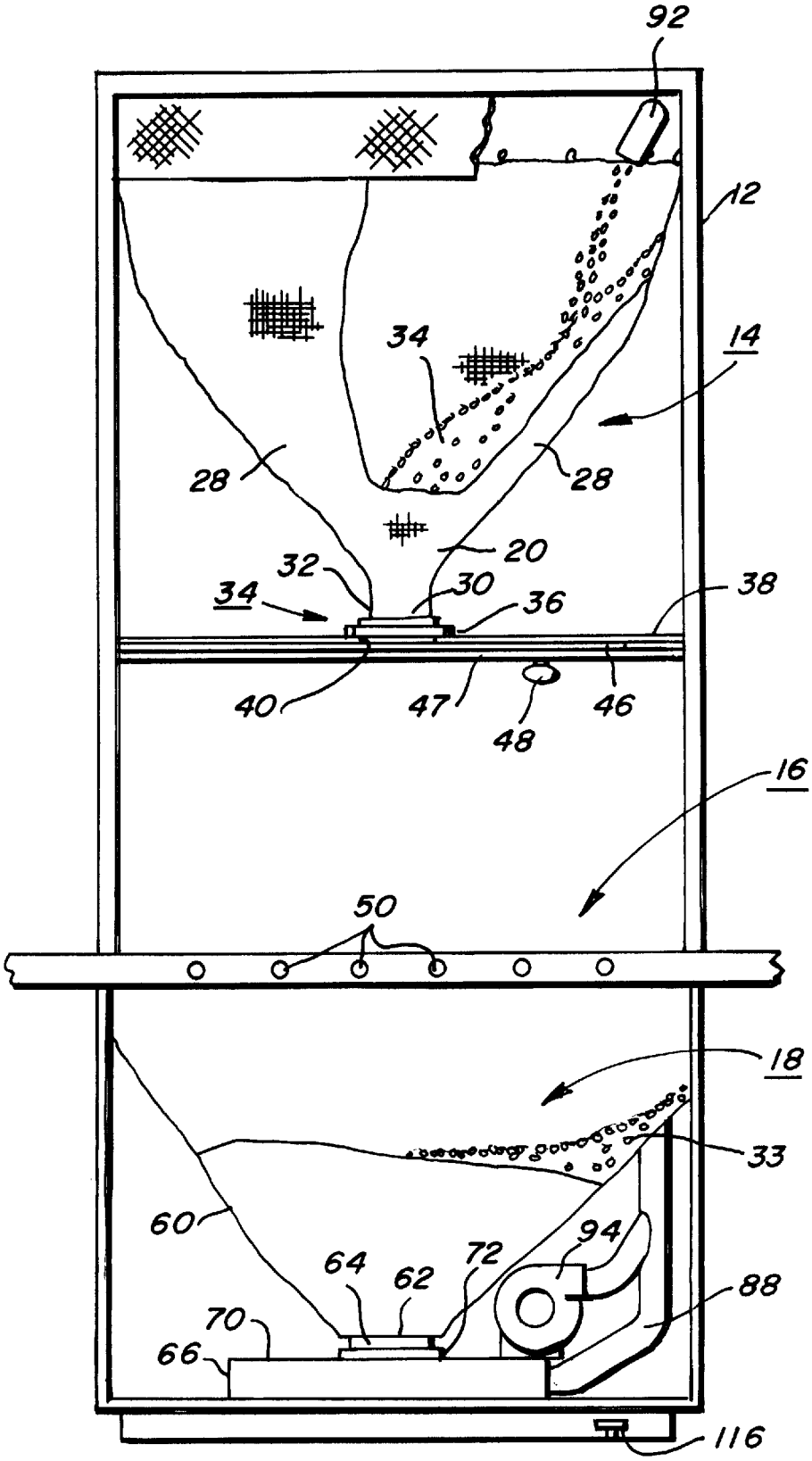
FIG. 2 is a front elevation of the apparatus shown in FIG. 1.
Figure 3:
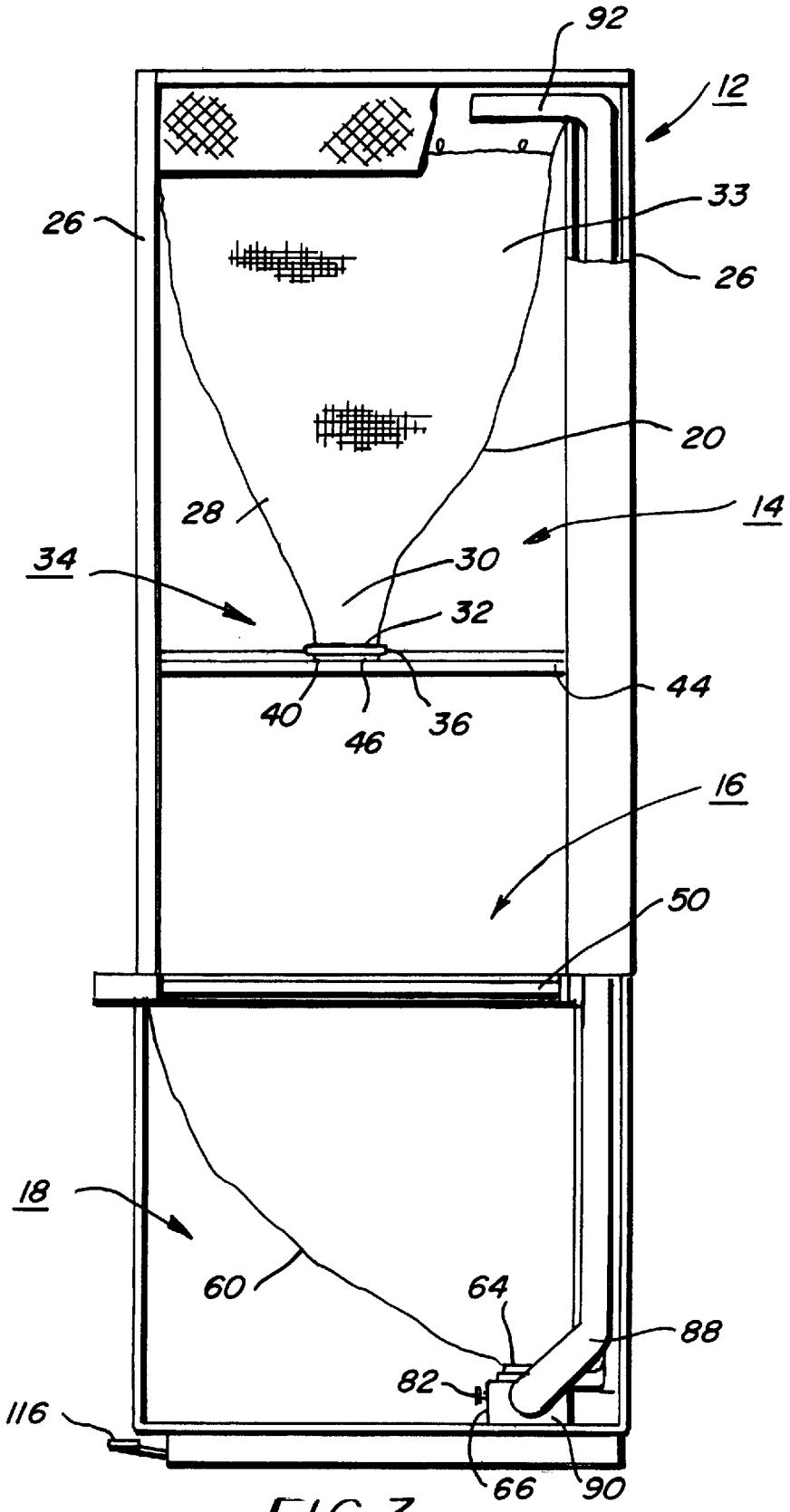
FIG. 3 is a side elevation of the apparatus shown in FIG. 1.

Referring to FIGS. 1–3, there is shown a material dispensing and recovery apparatus generally indicated by the reference numeral 10 having a frame 12 to which is attached for support the three components of the invention: a storage container 14 positioned at the upper end thereof, a work station 16 located directly below the container 14 in vertical alignment therewith, and a material collection station 18 located immediately below the work station.

The storage container station 14 includes a bag 20, having its upper end forming a square with corners 24 which are secured to the side members 26 of the frame 10. A cover, not shown, is arranged to close the upper end of the bag 20. The four sides 28 of the bag 20 taper downwardly and combine to form a circular opening 30 having a collar 32 attached therearound at the lower end of the bag 20. Particulate material, such as, packaging material in the form of what is known in the industry as "peanuts" or "popcorn", and illustrated by the numeral is 33, is transported into the bag 20, as will be discussed below.

As shown in FIGS. 2 and 3, the container collar 32 is associated with a valve system 34 comprising a ring member 36 to which the collar 32 is detachably secured, the ring member 36 being mounted on a fixed panel 38 and surrounding a circular opening 40 thereat. The panel 38 is arranged horizontally across the frame 12, and being secured thereon by suitable frame braces 44. To complete the valve system 34, a valve member 46 is slidably mounted relative to and below the panel 38 on a pair of rails 47 secured thereto, and being arranged to be moved selectively to a first position below the ring member 36 in order to close the opening 30 and prevent the flow of the material 33 out of the bag 20, or to a second position, as shown in FIG. 2, wherein the valve member is clear of the opening 30 to permit the flow of the material out of the bag. To assist in this operation, the panel 38 is provided with a knob 48 for permitting an operator to move the valve member to either of its operative positions. The valve system 34 serves to permit the manual control of the dispensing of the flow of particulate material from the bag 20.

The work station 16 provides the operator with a working position wherein shipping or storage cartons may be transported by a suitable conveying system for either receiving, or for removing packaging material therefrom. As shown in FIGS. 1–3, the station 16 comprises a work table having a plurality of spaced, bars 50 positioned with their axes generally in parallel and arranged in a horizontal plane immediately below, and centrally located relative to the opening 30 of the dispensing bag 20. The work station also includes folding table leaves 52, 54, one on each side of the plurality of rollers 50, and arranged in the same horizontal plane therewith for supporting the transporting of cartons to and from the work table of the plurality of the bars 50 by suitable conveyers, not shown.

During the first mode of operation of the apparatus 10, that is, in the filling of shipping or storage cartons with packaging material, a carton 56, containing a package 58 to be shipped or stored being postioned therein, is transported manually by way of the work table leaf 52 upon the roller bars 50 of the work table and immediately below the opening 30 for the dispensing bag 20. The operator moves the valve member 46 by use of the knob 48 to a position wherein the valve member is clear of the opening 30, as shown in FIG. 2, for permitting the flow of material 33 into the carton 56 and around the to-be-shipped or stored package 58. When the carton is filled as desired, the operator actuates the valve member 46 to close the opening 30 to terminate further flow of the material. The carton 56 is then removed or transported by a conveying system, not shown, so that other cartons may be filled in the same manner.

During the filling of the carton 56 and other cartons thereafter during a session of activity wherein a plurality of cartons are filled with packaging material, some of the dispensed material may fall by the wayside, that is, may not enter the cartons-to-be-filled, but rather, may spill or overflow onto the floor or through the spaced roller bars 50. As will be discussed below, such errant material can be retrieved and recycled for further dispensing without loss thereof.

Positioned below the plurality of roller bars 50, the collection station 18 comprises a downwardly tapered, collection bag 60 arranged to receive packaging material 33 flowing from the dispensing bag 20 as the material flows through the opening 30 therein, when the valve member 46 is in its second position of operation, and through the spaces between the roller bars 50. Such flowing of the material 33 reaching the collection bag 60 occurs during the filling operation of one or more cartons 56 as they pass across the array of the roller bars 50 when some of the material inadvertently fails to enter the cartons, or spills out therefrom.

The collection bag 60 is detachably supported on the frame 12 in the same manner as the dispensing bag 20, and tapers downwardly terminating to form a circular opening 62 having a collar 64 attached thereto. Material 33 falling into the bag 60 continues to fall through the opening 62, during the dispensing mode of operation of the apparatus 10, and into a transition chamber, such as a trap container 66, through an opening 68 formed in a top panel 70 therefor. A ring member 72 is fastened on the panel 70 in position to surround the opening 68, and is utilized for attaching the collar 64 for the collection bag to the trap 66 during the dispensing mode of operation. In this arrangement, the openings 62 and 68 are in communication whereby the material 33 is allowed to freely fall into the trap container.

Figure 5:
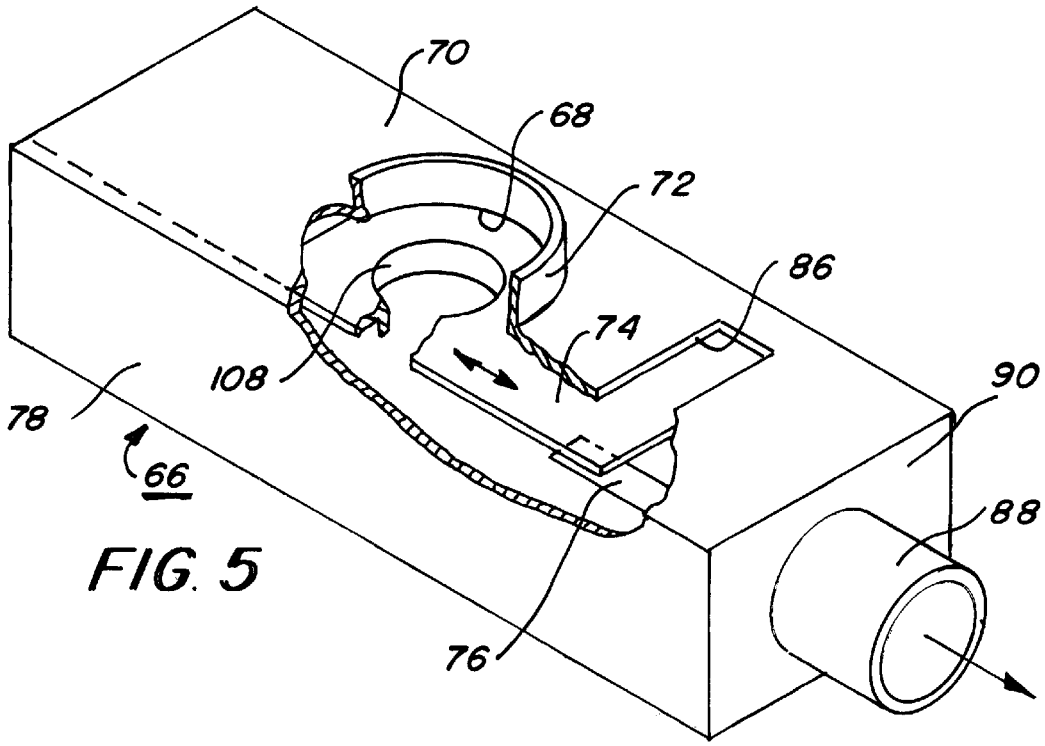
FIG. 5 is an isometric view of a collection trap device positioned below the workstation shown in FIGS. 2 and 3, in the position of operation to permit an operator to utilize a vacuum hose to remove material from cartons, and for cleanup purposes.

Within the trap container 66, as shown in FIG. 5, a valve plate member 74 is arranged immediately below the under surface of the top panel 70 for close sliding movement therealong. For this operation, a pair of rails 76, only one is shown, are mounted in spaced apart relationship in each of the upper longitudinal corners of the trap 66, and upon which the valve plate 74 is adapted to be moved in either direction. To produce this sliding movement, the operator reaches through the opening 68, grasps the underside of the valve plate 74, and moves the same in the desired direction.

To complete the structure of the trap 66, the top panel 70 is formed with a vent slot 86 arranged transversely positioned between the opening 68 and an output connector conduit or pipe 88 which projects out of one end 90 of the trap. The pipe 88, as shown in FIGS. 2 and 3, extending from the trap 66, is mounted vertically on the frame 12, and terminates in a horizontal directed extension 92 inside the upper supply container 20, at one corner thereof, so that material 33 flowing in the pipe 88 and through the extension 92, will blow into the supply container 20.

Figure 4:
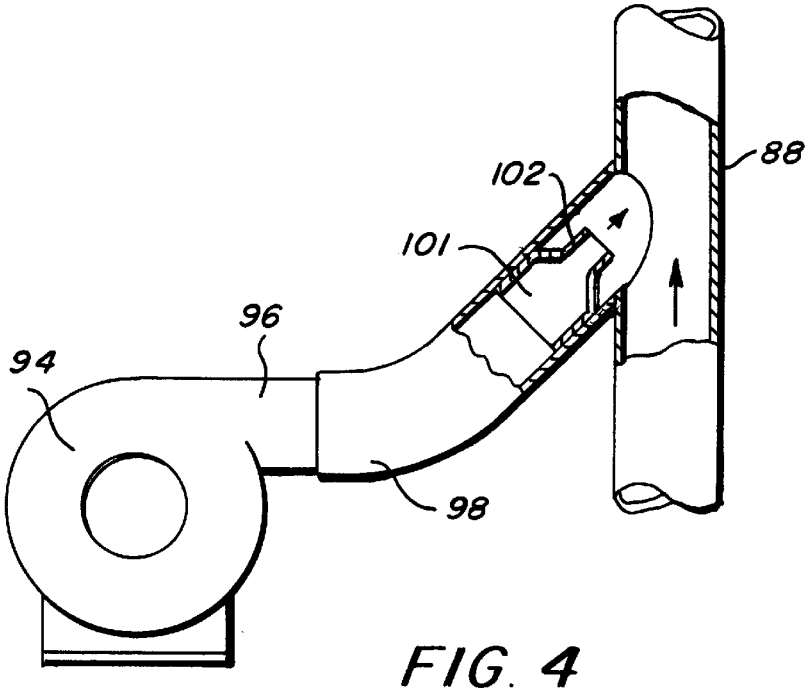
FIG. 4 is side elevation of the blower/vacuum mechanism utilized in the present invention.

As shown in FIGS. 2 and 4, a blower mechanism 94 is positioned within the collection station 18 adjacent the trap 66, having its output conduit 96 connected, at an angle by way of a pipe 98, to the pipe 88 to be in flowing communication therewith. Mounted within the pipe 98 is a restricting nozzle 100 arranged in such a manner that its narrowest tip 102, which has its most restrictive characteristic, is facing downwind of the air flow of the blower. In this manner, upon operation of the blower, when the apparatus 10 is in the dispensing mode of operation as will be described below, the air flowing through the restrictive tip 102 and into the pipe 88, as shown by the arrow, is at its highest speed thereby effecting a pressure drop in the adjacent space in the pipe 88. This Venturi Effect produces a lowering of pressure within the pipe 88 causing the flow of the particulate material from the trap 66, upwardly through the pipe 88 and into the dispensing bag 20. The blower mechanism 94 provides enough force to throw the packaging material 34 to the opposite corner of the supply bag 20 thereby resulting in the nearly 100% utilization of the bag capacity.

Figure 7:
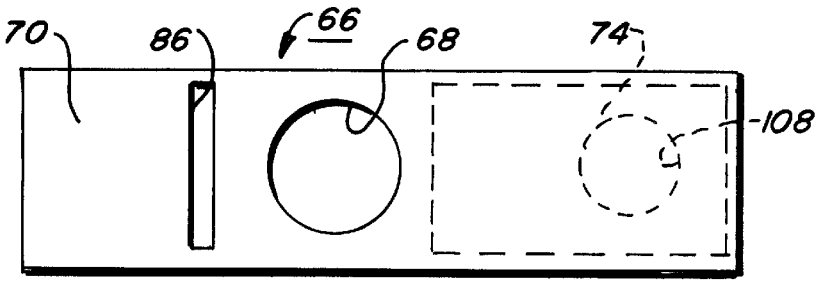
FIG. 7 is a schematic illustration of the trap container of FIG. 5 showing the position of parts thereof in the first mode of operation of the apparatus wherein material is removed from the collection container.

Conditioning the apparatus 10 for its dispensing mode of operation, requires the operator to slide the valve plate member 74, to the position shown in FIG. 7. This action removes the valve member 74 out of interference with the opening 68 for the trap 66, and, with the collar 64 for the collection bag 60 attached to the ring 72 on the trap, over flow particulate material which fails to fall into or remain in a carton, but instead drops upon the work table of the roller bars 50, will collect in the bag 60 and the trap. The operator may at any time, periodically, or during the entire time cartons are being filled, activate the blower 94 and initiate flowing movement of the errant material from the trap, conveyance thereof upwardly through the pipes, 88, 92 and back into the dispensing bag 20 for the reuse thereby. It will be noted that with the valve member 74 in the position shown in FIG. 7, the vent slot 86 is open to permit the entry of air within the trap, such condition being necessary for this mode of operation, in that air passing through the vent slot during operation of the blower produces turbulence within the collected material thereby facilitating its flow into and through the conduit pipe 88.

In a second mode of operation of the apparatus 10, the vacuum mode, the blower is utilized to effect the removal of particulate material which falls on the floor of the surrounding area for return to the dispensing bag 20, for reuse. Also, this mode of operation, may be utilized to effect the removal of particulate material from one or more cartons transported to and from the work station 16. As previously stated, it is preferred that the particulate material in packaging cartons transported to the worktable be dumped onto the worktable after shipped items have been removed therefrom, thereby saving the operator the time-consuming task of having to vacuum the material directly from the cartons.

Figure 8:
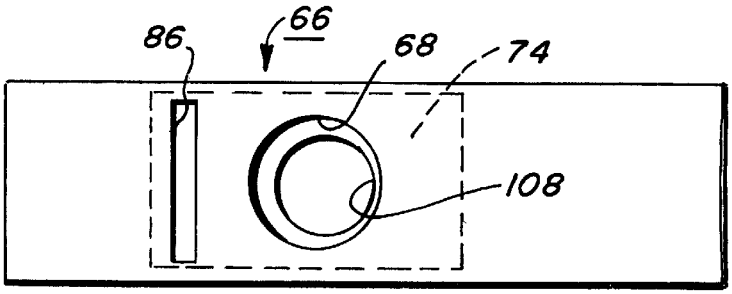
FIG. 8 is a schematic illustration of the trap container showing the parts thereof in the second mode of operation wherein vacuum conditions produced in the trap container is utilized to remove material from cartons, or for cleanup operations.
Figure 6:
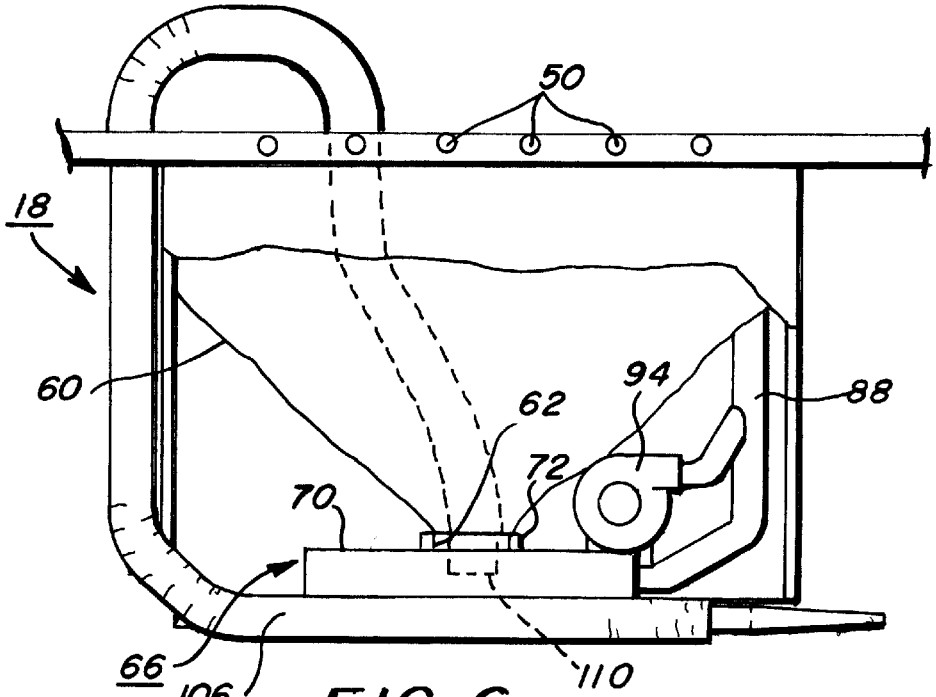
FIG. 6 is front elevational view of the material collection station showing the apparatus of FIG. 1 in condition for the vacuum mode of operation.

For either of these purposes, the apparatus is provided with a vacuum hose 106, and the trap 66 is structured to permit this operation, selectively. As shown in FIGS. 7 and 8, the valve plate 74 is formed with an opening 108 having a diameter smaller than the opening 68 but sufficient to permit the entry and holding of the input fitting 110 of the hose 106 by a suitable coupling, not shown. The other end of the hose is provided with the conventional nozzle 112 for handling by an operator. For utilizing either function in the second mode of operation, the operator initially actuates the valve system 34 to prevent the flow of material from the dispensing bag 20. He then manipulates the valve plate 74 to the position shown in FIG. 8, wherein the opening 108 is within the confines of the larger opening 68 and the slot 86 is closed. The input fitting 110 for the vacuum hose is then projected through the rollers 50 on the work table, and applied to and secured within the opening 108 so as to place the hose in communication with the interior of the trap container, as shown in FIG. 6. Upon activation of the blower 94, the vacuum hose is now ready for use in floor cleanup, or to remove material from cartons, and the vacuum system is conditioned to convey the material back to the dispensing bag 20 by way of the Venturi effect within pipes 88, 92, as aforesaid.

From the foregoing, it will be understood that the disclosed invention of a material dispensing and recovery system provides the two indispensible modes of operation in the handling of particulate material, particularly packaging material. In the first mode of operation, outgoing packaging cartons are filled with the material from an overhead dispensing container easily and without regard to overflow or otherwise misplacement of the material which can be easily recovered without employing or using unnecessary manpower or time. In the second mode of operation, particulate material, removed from incoming packing cartons by the upending thereof and dumping onto the work table, is transported to the supply dispensing container by a vacuum system operatively integrated with the recovery arrangement used in the first mode of operation. The second mode of operation also permits an operator to recover errant material which has fallen to the floor or surrounding areas and to return this material back into the dispensing system for the apparatus of the invention.

It will be appreciated that the provision of the aforedescribed work table, its strategic location, and the multiple functions made available by its construction and position, provides a packaging apparatus that is adapted to solve many of the specific problems in the packaging industry, as mentioned in the foregoing. The use of the specifically devised bag and trap container in the material recovery system for receiving and initiating the transporting of the material permits the dual function of handling overflow or spilled material during the dispensing operation, and the handling of dumped material from incoming cartons as well as the material to be vacuumed off the floor. The disclosed trap container, in conjunction with the blower arrangement therefor, provides a conveying system capable of being built using simple and inexpensive parts, smaller gauge piping and fittings, while at the same time being adapted to produce high volume movement of the material back into the supply dispensing bag.

Figure 9:
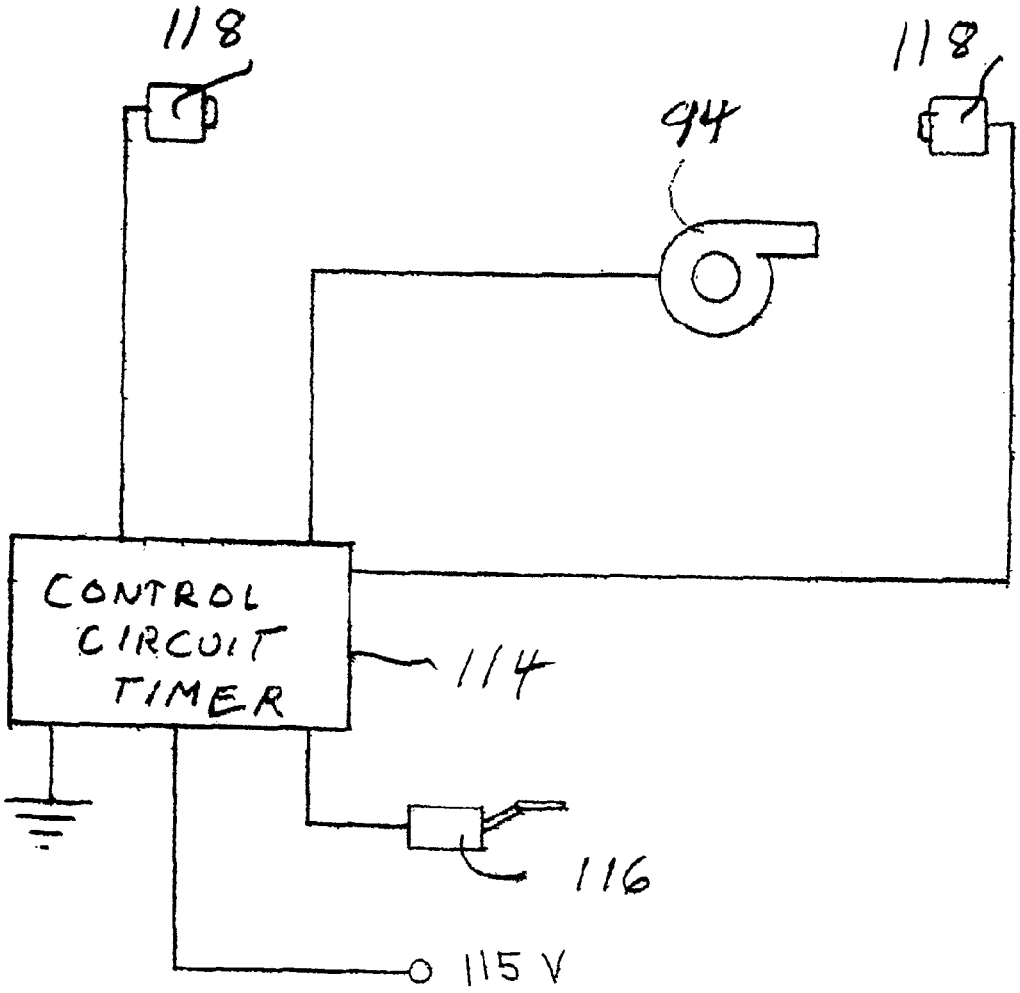
FIG. 9 is schematic circuit diagram of an electrical system for use in the apparatus of FIG. 1.

It will also be appreciated that during the operation of dispensing material into cartons, and during the unpacking of items from cartons, the blower 94 may be operated manually by the operator for periodic removal of the material from the collection bag 60 and the trap 66, as aforesaid, in timed sequence, or automatically. To this end, the apparatus 10 is provided with a circuit for energizing the blower 94 accordingly. As shown in FIG. 9, the blower is adapted to be electrically energized by means of a circuit/timer system 114 to which is connected a foot operated switch 116, see also FIGS. 2 and 3, for the operator's use. Stepping on this switch at any time will effect energization of the blower, when the recovery system of the trap 66 is in its first mode of operation, thereby removing some or all of the material 33 from the bag 60, as desired, during the dispensing of material into cartons. In the alternative, level sensing devices 118, suitably positioned within the bag 60 to sense the level of the material therein, may be utilized to energize the blower automatically when the level of the material attains a predetermined level. Similarily, the control circuit 114 may include a timer device for periodically energizing the blower.

What is claimed is:

1. In a packaging apparatus for dispensing particulate material from a supply source into outgoing packaging cartons, for removing particulate material from incoming cartons containing same, and for returning the material to the supply source for reuse, having a work table for supporting outgoing cartons and incoming cartons, the work table being formed with open spaces for permitting the passing of spilled and overflow material and the material from incoming cartons by the upending of the same, a receiving container positioned below the work table for receiving the material passing therethrough, and a conduit system in air flowing communication between the supply container and the receiving container, the improvement including;

a transition container positioned below the work table in material flow communication with the receiving container being arranged for receiving material therefrom, a vacuum producing system in communication between said transition container and the conduit system being arranged for producing vacuum conditions in said transition container and said conduit system for conveying material received therein and into the conduit system for return to the supply container, said transition container including a valve device arranged for selectively introducing air therein during said vacuum conditions for producing air turbulence within said transition container and thereby facilitating the drawing of the material from the transition container and into the conduit system during transporting to the supply container.

2. The packaging apparatus as defined in claim 1 wherein said vacuum producing system includes a blower mechanism having an output conduit with a Venturi device operable therein being arranged to produce said vacuum conditions in said transition container therein and to blow the material through the conduit system and back into the supply container.

3. The packaging apparatus as defined in claim 1 including hose means having one end adapted to be selectively connected to said transition container when under said vacuum conditions, said hose means having an input end for manually removing material from incoming cartons, and for retrieving material spilled upon the surrounding areas for return to the supply container.

* * * * *